US006886375B2

(12) United States Patent
Amo

(10) Patent No.: US 6,886,375 B2
(45) Date of Patent: May 3, 2005

(54) HANDCUFF RESTRAINT MECHANISM AND METHOD OF USE

(76) Inventor: Paul J. Amo, 1171 Upper Hill Rd., Middlesex, NY (US) 14507

( * ) Notice: Subject to any disclaimer, the term of this patent is extended or adjusted under 35 U.S.C. 154(b) by 3 days.

(21) Appl. No.: 10/609,220

(22) Filed: Jun. 27, 2003

(65) Prior Publication Data

US 2004/0261471 A1 Dec. 30, 2004

(51) Int. Cl.[7] ..... E05B 75/00
(52) U.S. Cl. ..... 70/16; 403/93; 403/105
(58) Field of Search ..... 70/15–17; 403/83, 403/103–108, 325–328, 90–96

(56) References Cited

U.S. PATENT DOCUMENTS

| | | | | | |
|---|---|---|---|---|---|
| 372,510 | A | * | 11/1887 | Bean | 70/16 |
| 1,342,334 | A | * | 6/1920 | Kruger | 70/16 |
| 1,456,846 | A | | 5/1923 | Gamwell | |
| 1,572,262 | A | * | 2/1926 | Abbenzeller | 70/16 |
| 1,579,333 | A | | 4/1926 | Neal | |
| 1,900,242 | A | | 3/1933 | Latou | |
| 2,388,766 | A | * | 11/1945 | Ruttiman | 70/16 |
| 2,759,349 | A | | 8/1956 | McKee | |
| 2,966,787 | A | | 1/1961 | Tompkins | |
| 3,423,871 | A | * | 1/1969 | Foley | 70/16 |
| 3,618,345 | A | | 11/1971 | Smith | |
| 4,138,867 | A | | 2/1979 | Tompkins | |
| 4,287,731 | A | | 9/1981 | Kruger | |
| 4,300,368 | A | | 11/1981 | Sullivan | |
| 4,314,466 | A | | 2/1982 | Harris | |
| 4,574,600 | A | | 3/1986 | Moffett | |
| 4,694,666 | A | * | 9/1987 | Bellingham et al. | 70/16 |
| 4,697,441 | A | | 10/1987 | Allen | |
| 4,840,048 | A | | 6/1989 | Elam | |
| 5,205,142 | A | | 4/1993 | Kruger et al. | |
| 5,461,890 | A | | 10/1995 | LeFavor | |
| 5,526,658 | A | | 6/1996 | Cross et al. | |
| 5,598,723 | A | | 2/1997 | Ecker et al. | |
| 5,613,381 | A | | 3/1997 | Savage | |
| 5,687,593 | A | | 11/1997 | Cross | |
| 5,697,231 | A | | 12/1997 | Tobin, Jr. | |
| 5,797,284 | A | | 8/1998 | Lurie | |
| 6,026,661 | A | | 2/2000 | Spiropoulos | |
| 6,311,529 | B1 | | 11/2001 | Kang | |
| 6,349,574 | B1 | * | 2/2002 | Lurie | 70/16 |
| 2002/0189302 | A1 | | 12/2002 | Anderson | |

FOREIGN PATENT DOCUMENTS

| | | | | |
|---|---|---|---|---|
| GB | 2268778 A | * | 1/1994 | E05B/75/00 |

* cited by examiner

*Primary Examiner*—Daniel P. Stodola
*Assistant Examiner*—Christopher Boswell

(57) ABSTRACT

A restraint mechanism for a set of handcuffs, the handcuffs including a pair of openable bracelet sections, each of the bracelet sections including a locking mechanism for opening and closing a bracelet section. The bracelet sections are tethered together by a linkage that includes a restraint mechanism that permits a bracelet section to be rotated about an axis extending through the linkage and the bracelet sections so as to rotate said bracelet section in a first rotational direction to a predetermined angular position, but in which the bracelet section is prevented from movement in a second reverse rotational direction once the predetermined angular position has been achieved.

22 Claims, 11 Drawing Sheets

HANDCUFF RESTRAINT MECHANISM AND METHOD OF USE

FIELD OF THE INVENTION

This invention relates to the field of prisoner handcuffs and more specifically to a selectively lockable restraint mechanism incorporated into a set of handcuffs to aid in the use thereof.

BACKGROUND OF THE INVENTION

Handcuffs have been repletely known for well over a hundred years in the field of law enforcement as used in the incarceration of criminals and criminal suspects. Standard handcuffs, such as those that are described in U.S. Pat. No. 6,311,529, include a pair of lockable cuff or bracelet sections, each of the bracelet sections being defined by respective arcuate cheek and jaw members that are pivotally secured by means of a locking mechanism that is carried on the cheek member. The locking mechanism includes one or more gears that are engageable with a row of teeth carried by the pivotal jaw member, wherein the locking mechanism can be selectively disengaged and the bracelet sections opened by means of a key.

A number of significant developments have taken place over time to incorporate new and varied forms of locking mechanisms into the bracelet sections of the handcuffs, but very few developments have been made with regard to the interconnection between the bracelet sections. Typically, the lockable bracelet sections are tethered together by a linkage consisting of several chain links fixedly attached to the end of each bracelet section.

A number of ways have been developed for defeating or minimizing the effective use of handcuffs, once attached to a suspect, due in part to the above linkage. For example, in those instances where a person has the handcuffs attached behind their back, the present interconnection between the bracelet sections is sufficiently flexible to permit a cuffed individual to "step through" the handcuffs by pulling the handcuffs behind their legs, which can be accomplished, for example, when the detained individual is seated in a police vehicle. Once the handcuffs are in front of the individual, it is much easier for the detained individual to run or to achieve better balance. Moreover, the individual would also be able to better access a shirt pocket, for example, to retrieve a hidden handcuff key, to obtain a weapon or to hide evidence. Though restrained to some extent, it is also possible for a handcuffed individual to still use his or her hands to grab an officer, such as from behind when the officer has his or her back turned from the suspect or to attempt to grab an officer's sidearm by making contact with the officer, given the relative amount of freedom of the arms and hands that are provided using present handcuffs.

There have also been numerous court cases that have involved handcuffs which have been made by detainees, due in part to the discomfort and injury stemming from their use. Some of these cases have resulted in significant monetary awards.

As noted above, there have been a few improvements developed in the linkage between the lockable bracelet sections, such as described, for example, by a restraint mechanism that is shown and described in U.S. Pat. No. 6,026,221 to Spiropoulos. According to this patent, a spool/reel system is introduced between the bracelet sections in a separate housing assembly. This system permits the spacing between the bracelet sections to be selectively adjusted as needed, much like a leash. This design, however, does not address the problems of "step through" as noted above and further enlists an entirely new mechanism that is likely to be incompatible with existing handcuffs without requiring significant redesign.

According to another developed technique, the chain linkage is replaced with a hinged interconnection between the bracelet sections. This design is repletely described in U.S. Pat. Nos. 2,966,787 and 4,138,867, each to Tompkins, U.S. Pat. No. 4,300,368 to Sullivan, U.S. Pat. No. 5,205,142 to Kruger et al., U.S. Pat. No. 5,461,890 to LeFavor, U.S. Pat. No. 5,526,658 to Cross et al., U.S. Pat. No. 5,598,723 to Ecker et al and U.S. Patent Publication No. 2002/0189302A1 to Anderson. In each of these references, the lockable bracelet sections are interconnected by a hinge assembly in which the hinging axis is arranged in a direction that is essentially perpendicular to the pivot axis of the bracelet sections. This hinging assists in the foldability of the handcuffs, but is not particularly effective in solving the above stated problems related to more effectively restraining a cuffed individual.

According to yet another improvement design, as described in U.S. Pat. No. 5,697,231 to Tobin, Jr., a pair of handcuffs are defined by respective bracelet sections that are attached to one another through a linkage assembly that includes at least one swiveling pin. This connection provides some flexibility in that three degrees of freedom are defined for an improved movement capability of the bracelet sections, but this flexibility in and of itself also does not adequately address or solve the problems that are discussed above.

SUMMARY OF THE INVENTION

It is therefore a primary object of the present invention to overcome the above-noted deficiencies of the prior art.

It is another primary object of the present invention to provide a set of handcuffs that can be more effectively used than those that are presently available.

It is yet another primary object of the present invention to create a linkage mechanism for a set of handcuffs, wherein the linkage mechanism can be selectively adjusted for locking purposes in order to more effectively restrain a suspect and without significant modification or training for the user being required.

Therefore and according to a preferred aspect of the present invention, there is provided a set of handcuffs comprising:

a pair of openable bracelet sections, each of said bracelet sections including a locking mechanism for opening and closing the bracelet section; and linkage means for tethering said bracelet sections together, said linkage means including a selectively operable restraint mechanism including means for permitting selective rotation of at least one of said bracelet sections about an axis extending through said bracelet sections to a predetermined angular position in which the bracelet section can be locked in said position.

Preferably, the restraint mechanism of the present invention includes at least one ratchet gear attached to the linkage means, the gear being rotatable about a linkage axis. The ratchet gear includes a number of circumferentially disposed teeth that are engaged on opposing sides thereof by spring-loaded ratchet pawls attached to the at least one rotatable bracelet section. As the bracelet section is caused to rotate, the spring-loaded pawls are caused to engage with one of the pair of the teeth of the ratchet gear at a predetermined angular position. This engagement restricts further movement of the ratchet gear in one rotational direction and therefore locks the bracelet sections, as secured to an individual, from returning to their original or nominal position until the bracelet sections are opened.

The resulting movement caused by the rotation of the bracelet section about the linkage axis causes the arms of a detainee to be rotated relative to one another and placing the arms from a vertical to a horizontal attitude with the arms crossing one another, depending on the amount of rotation applied. Once the arms have been placed in this position, they cannot be returned to their original or nominal position against the restraint mechanism. Additional movement of the bracelet section in the original rotational direction is still possible, but due to the restraint of the arms, the bracelet sections cannot be restored to their original position without opening the bracelet locking mechanism.

According to another preferred aspect of the present invention, there is disclosed a method of restraining an individual using a set of handcuffs, said method including the steps of:

cuffing an individual using said handcuffs; and rotating one of the bracelet sections of said handcuffs to a predetermined angular position relative to the other of said bracelet sections about a linkage axis in a first rotational direction, said handcuffs including a restraint mechanism preventing said bracelet section from being rotated to an original or previous position in an opposite second rotational direction once said bracelet section has been rotated to the predetermined angular position.

Preferably, the method includes the step of cuffing a person behind the back and then selectively rotating the arm of the detainee into a position that prevents step through. The restraint mechanism of the handcuffs thereby causes the bracelet section to be rotated to a predetermined angular position and locked therein. The method can also be performed by hand cuffing a person with their arms in front and similarly rotating one of the bracelet sections or the arms to place the arms in a more secure position. The method includes rotation of the handcuffed arms to any one of more predetermined angular positions (e.g., 90°, 135°, 180°, etc)

An advantage of the present invention is that the present restraint mechanism does not significantly affect the overall design application of previously known handcuffs, including the bracelet locking mechanism.

Another advantage of the present invention is that provision of the herein described restraint mechanism does not alter the foldability of the handcuffs or otherwise restrict the handcuffs from fitting into conventional handcuff holders. Moreover, no new training is necessarily required for use.

The selective locking feature of the present restraint mechanism offers a number of useful advantages. First, handcuffing a detainee behind the back using handcuffs having the above described restraint mechanism is much more secure than with previous systems, and is, in fact, actually more comfortable for the detainee.

An essential advantage provided by the handcuff restraint mechanism of the present invention is that "step-through" (that is, bringing the cuffed hands from the rear to the front of the detainee) is made virtually impossible.

Even when used on individuals that are cuffed from the front, the present restraint mechanism can be used to manipulate the arms of the suspect into a secure position, therefore making it much more difficult for the suspect to reach his or her pockets to retrieve a hidden handcuff key, to reach for a hidden weapon, or to get rid of evidence. As a result handcuffing, whether performed to the front or the back of the detainee, is made much more secure and effective. Moreover, proper use of the herein described restraint mechanism makes it literally impossible for a detainee to take an officer's weapon by contact therewith or to use his hands to grab an officer or others, especially from behind, by placing the arms around the officer's neck. As a result, law enforcement officers can feel much more confident and secure when handcuffing a subject in the front, making it easier to gain a subject's trust and cooperation.

These and other objects, features and advantages will become readily apparent from the following Detailed Description which should be read in conjunction with the accompanying drawings.

DETAILED DESCRIPTION

The following description relates to specific embodiments of a selectively adjustable and lockable restraint mechanism for a set of handcuffs, as well as a related method for using the described restraint mechanism in the detainment of an individual. It will be readily apparent to those of ordinary skill in the field from the discussion that follows, however, that there are variations of this mechanism that can accomplish the functions of the herein described restraining method. In addition, certain terms are used throughout such as "top", "upper", "lower", "bottom", "lateral", and the like. These terms are used in order to establish an effective frame of reference when referring to the accompanying drawings. These terms, however, should not be regarded as limiting with regard to the intended scope of the present invention, except where specifically indicated.

Figure 1:
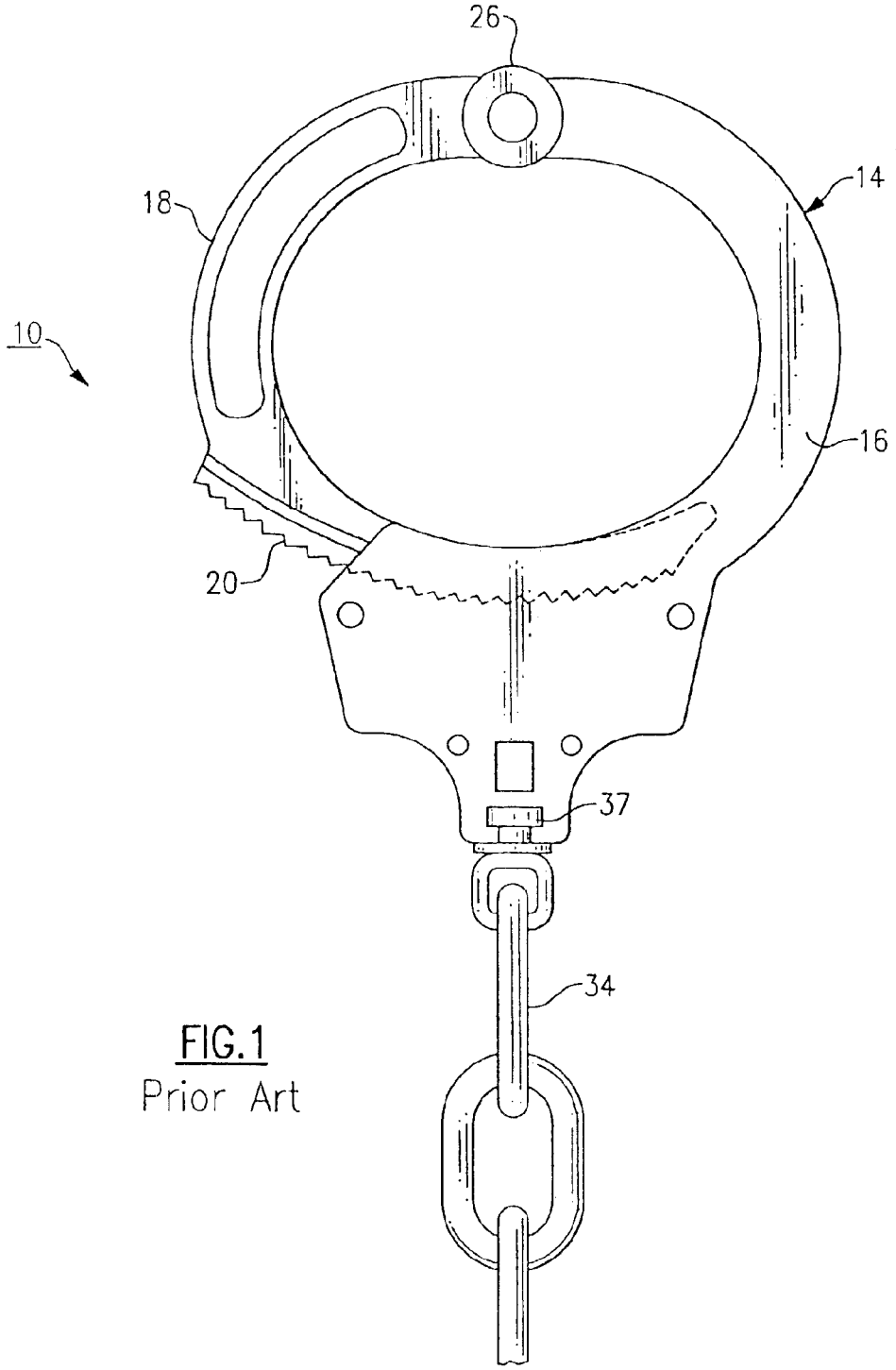
FIG.1 Prior Art
FIG. 1 is a partial perspective view, partially in section, of a prior art set of handcuffs.

For purposes of background, reference is first made to FIG. 1 illustrating a prior art set of handcuffs, identified herein as 10. The handcuffs 10 include a pair of respective lockable bracelet or cuff sections, only one of which 14 is shown. Each respective bracelet section 14 includes a cheek member 16 and a jaw member 18, respectively, each of these members being made from stainless steel or similar material and being arcuately shaped. The jaw member 18 is pivotally attached to the cheek member 16 at a center pivot point 26 so as to permit rotation over a span of 360 degrees thereabout, the bracelet section being defined in a loop-like configuration for adjustably fitting about a person's wrist. The jaw member 18 includes a row of arcuate exteriorly arranged teeth 20 that are aligned to interface with gears (not shown) of a locking mechanism (not shown) that is carried within the interior of the cheek member 16. Additional details concerning the bracelet sections, including the locking mechanism, can be found in U.S. Pat. No. 6,311,529, the entire contents of which are herein incorporated by reference. It should be pointed out, however, that the locking mechanism that is used in connection with the bracelet sections 14 of the handcuffs 10 is not intended to be a novel part of this invention and is noted herein only by way of example. In fact, it is believed that literally any known form of bracelet section locking mechanism can be utilized integrating the handcuff linkage of the present invention as described below.

Still referring to FIG. 1, the bracelet sections 14 of this known set of handcuffs 10 are separated from one another by a simple fixed chain linkage 34. This linkage 34 includes a pin 37 that is fixedly mounted into the proximal end of the cheek member 16. Due to this linkage, the bracelet sections 14 are not permitted to twist or otherwise assume other positions relative to one another, whether the handcuffs 10 are placed onto an individual or otherwise.

Figure 2:
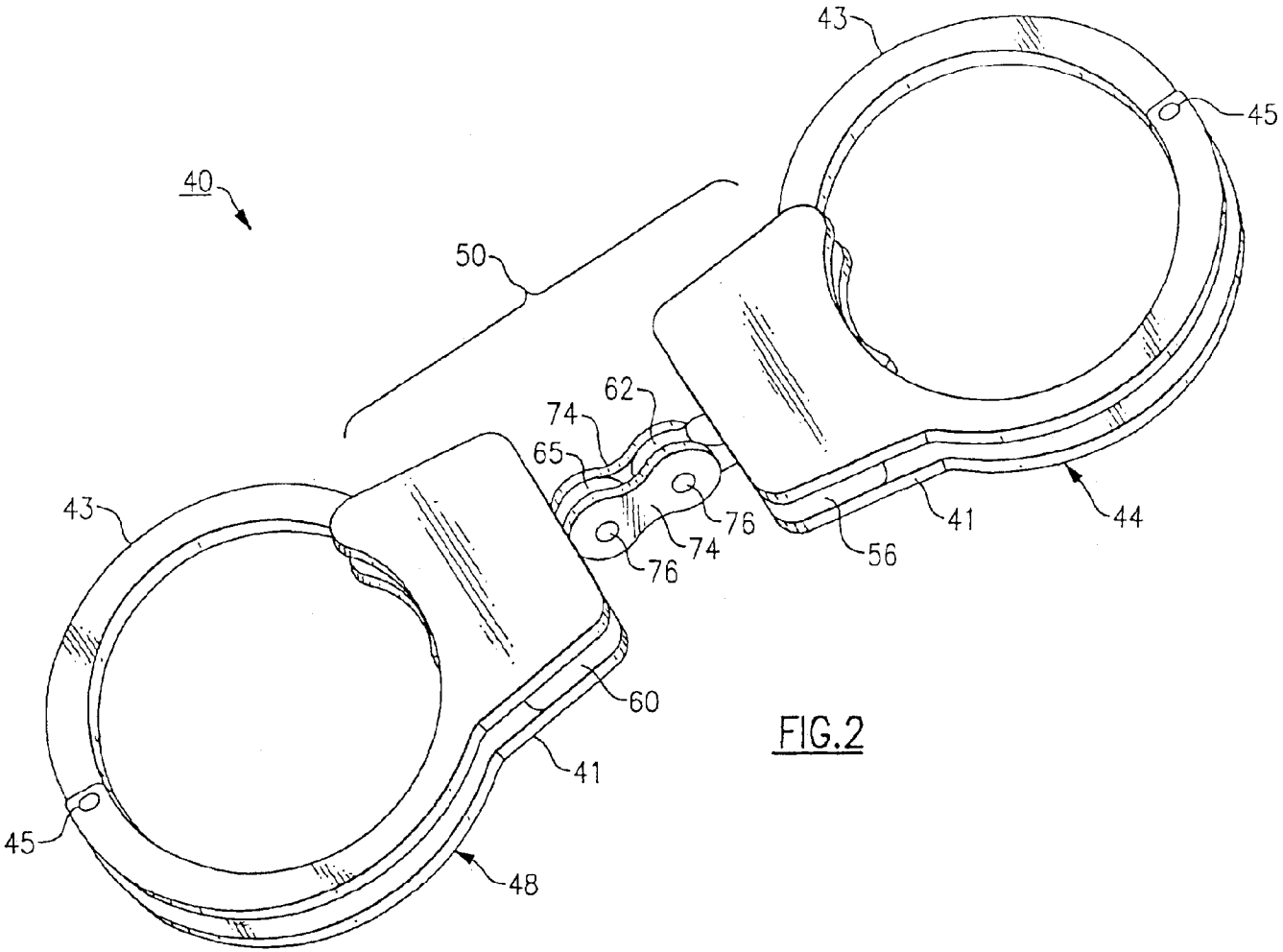
FIG. 2 is a perspective view of a set of handcuffs made in accordance with a preferred embodiment of the present invention.
Figure 3:
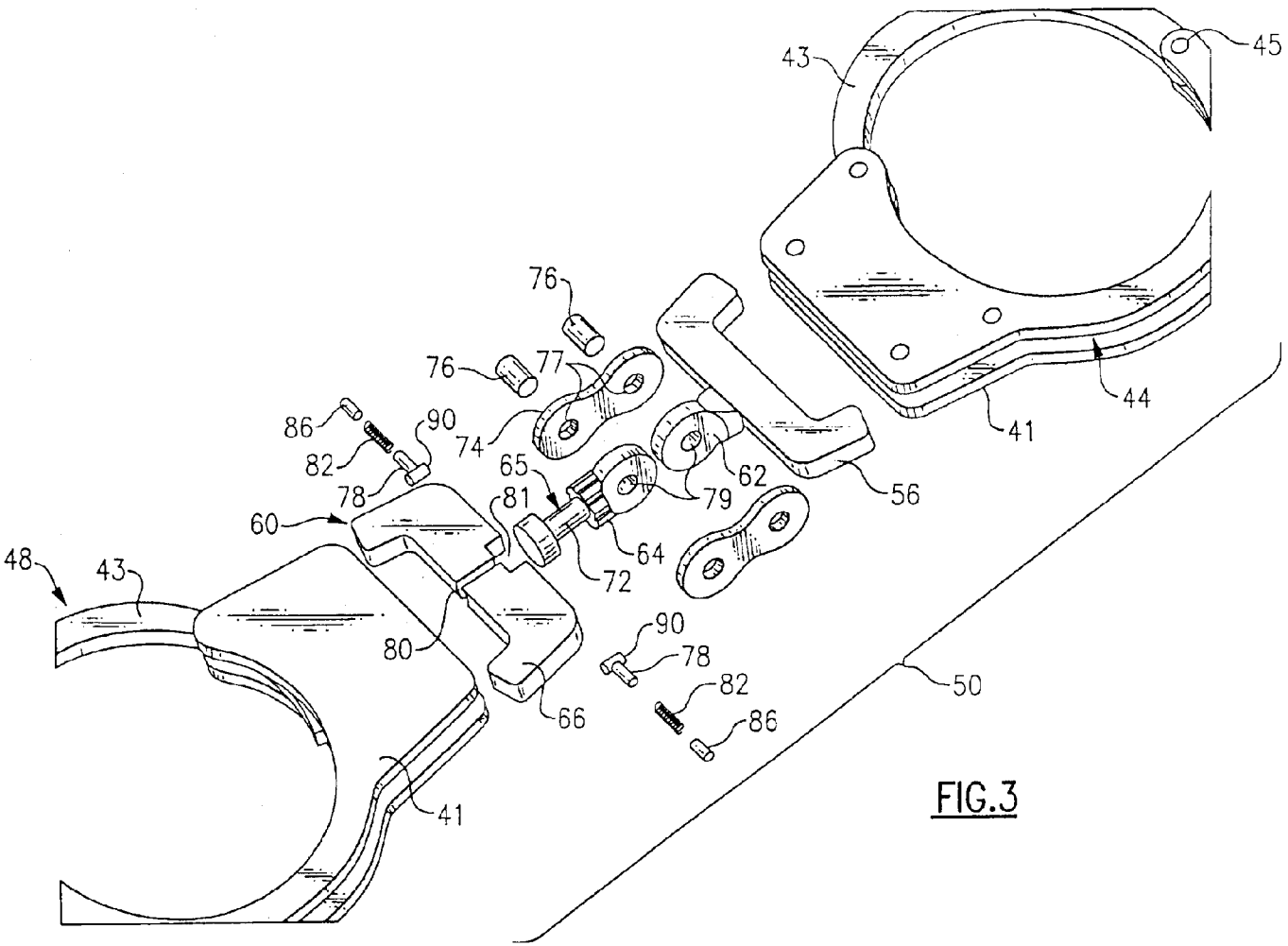
FIG. 3 is an exploded view of the selectively adjustable restraint mechanism of the handcuffs depicted in FIG. 2.
Figure 4:
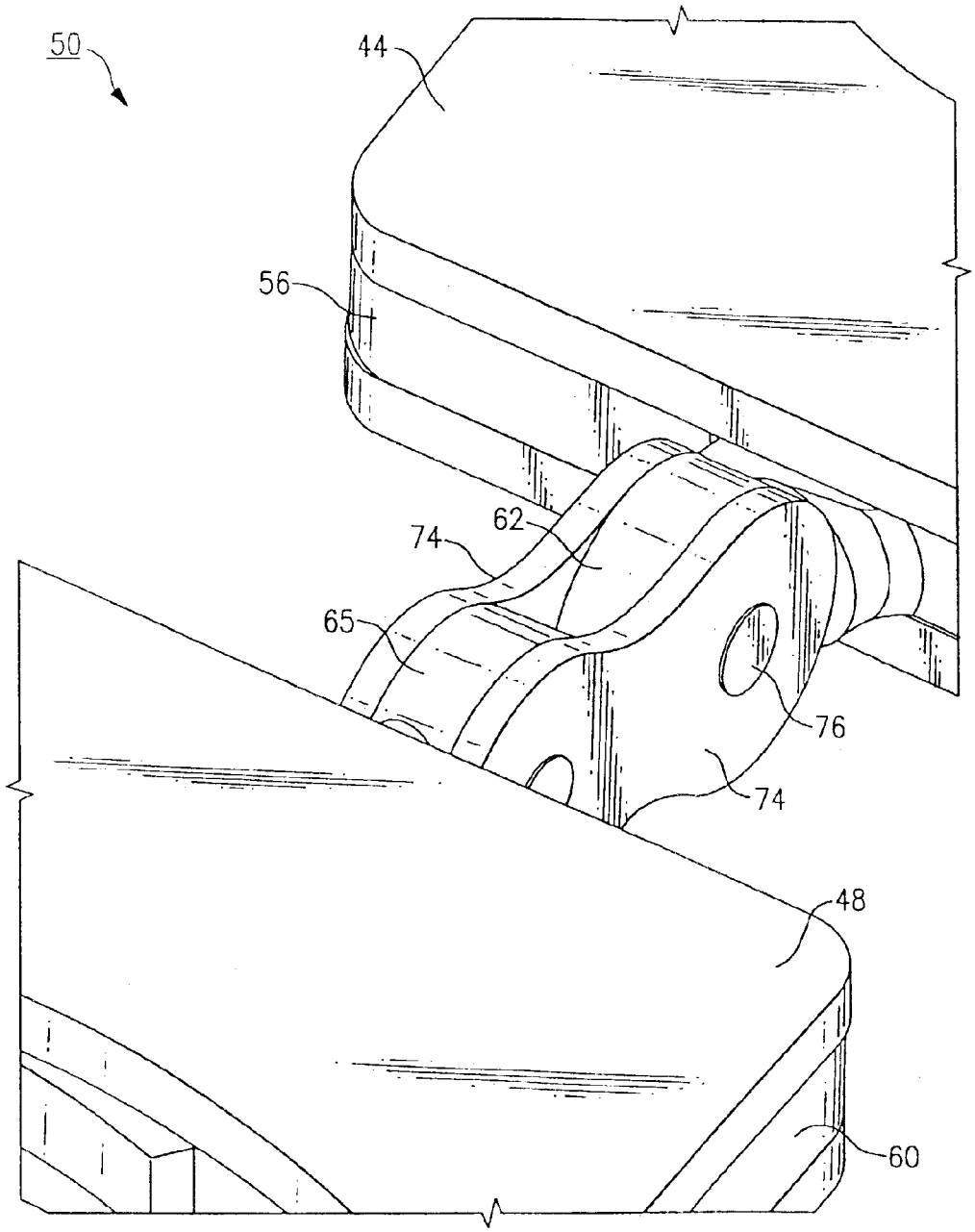
FIG. 4 is an enlarged partial view of the adjustable restraint mechanism depicted in FIGS. 2 and 3.
Figure 5:
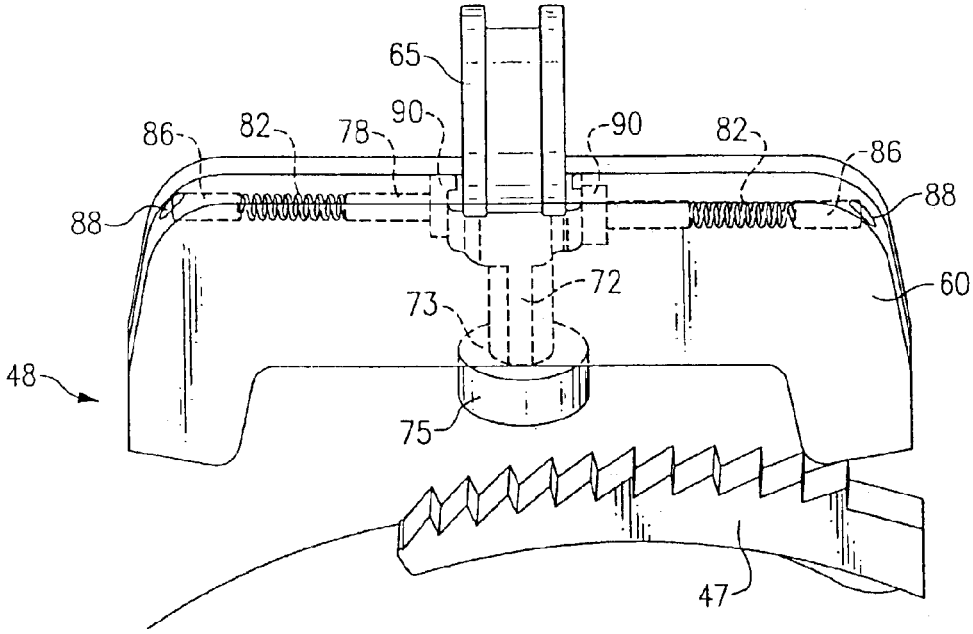
FIG. 5 is an partial perspective view, partially cut away, of the restraint mechanism of FIGS. 2–4.
Figure 6:
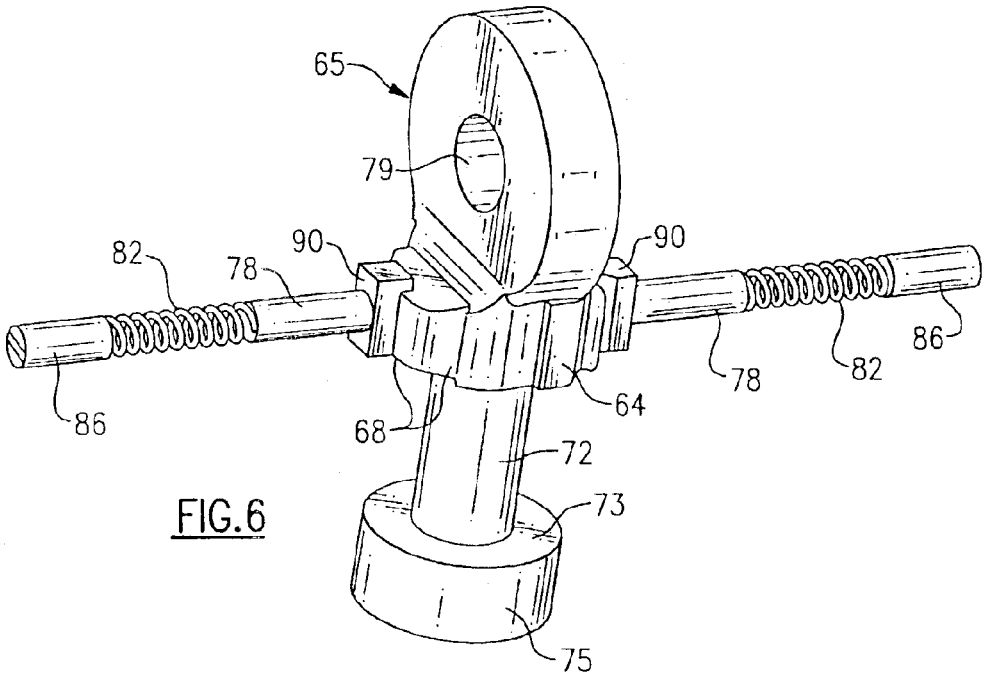
FIG. 6 is an enlarged perspective view of a portion of the restraint mechanism of FIGS. 2–5.

Referring to FIGS. 2–4, there is shown a pair of handcuffs 40 made in accordance with a preferred embodiment of the present invention. Like the preceding, these handcuffs 40 are defined by a pair of matching bracelet sections 44, 48, each of the bracelet sections including a corresponding cheek member 41 and a jaw member 43. The cheek member 41 and the jaw member 43 are constructed in the manner previously described with regard to the prior art handcuffs 10 of FIG. 1, wherein the jaw member is pivotally attached at a center pivot point 45 and in which each of the bracelet sections 44, 48 include a locking mechanism that permits locking engagement between a set of arcuate teeth 47, FIG. 5, disposed on a facing surface of the jaw member and locking elements of the locking mechanism (not shown) once one or both of the bracelet sections have been fitted onto the wrists of a suspect. As noted above, the locking mechanism of the handcuffs 40 themselves is entirely conventional and does not, in and of itself, form an essential part of the present invention.

Turning to FIGS. 2–6, the restraint mechanism 50 according to the present embodiment includes a pair of support yokes 56, 60. Each of the support yokes 56, 60 are fixedly attached to a proximal end of a cheek member 43 of a respective bracelet section 44, 48 by conventional means, such as through welding or by means of suitable fasteners. Alternately, the support yokes 56, 60 can be integrated into the design of the bracelet sections 44, 48, provided adequate clearance has been made relative to a contained bracelet locking mechanism (not shown).

Figure 10:
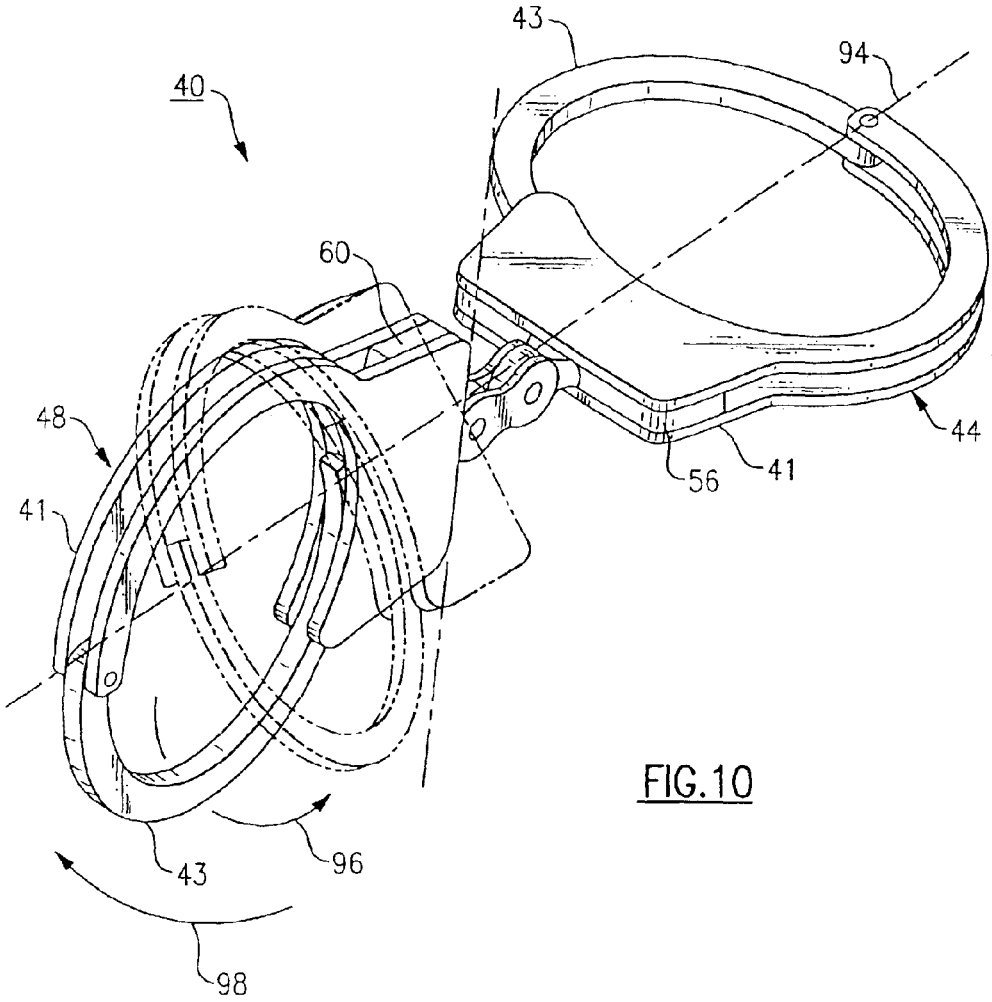
FIG. 10 is a top perspective view of the handcuffs of FIGS. 2–7 illustrating the rotatability of the cuff sections in accordance with the present invention.

A flexible linkage is attached to the proximal ends of each of the support yokes 56, 60, the linkage extending therebetween along a defined linkage axis 94, the axis being shown in FIG. 10. According to this embodiment, the linkage includes a pair of oblong steel links 62, 65 that are constructed in similar fashion to a portion of a bicycle chain drive, the links being axially and pivotally connected to one another through a pair of elongate cover plates 74 having a pair of openings 77 that are each sized to receive a set of suitable fasteners 76 that engage corresponding aligned openings 79 provided in each of the links 62, 65 to interconnect same. The link 62 is fixedly attached by conventional means to the support yoke 56 at the opposite or unconnected end thereof.

The remaining link 65 is rotationally attached to the support yoke 60. The link 65 further includes a cylindrical axle portion 72 terminating at a hub 75, each of which are insertable into a slot 80 formed between respective half sections 66 of the support yoke 60. As assembled and shown in FIG. 5, the hub 75 extends into the interior of the bracelet section 48, partially shown, and an interior facing surface 73 thereof engages the distal end of the support yoke 60, which is fixedly supported by the bracelet section 48.

Figure 7:
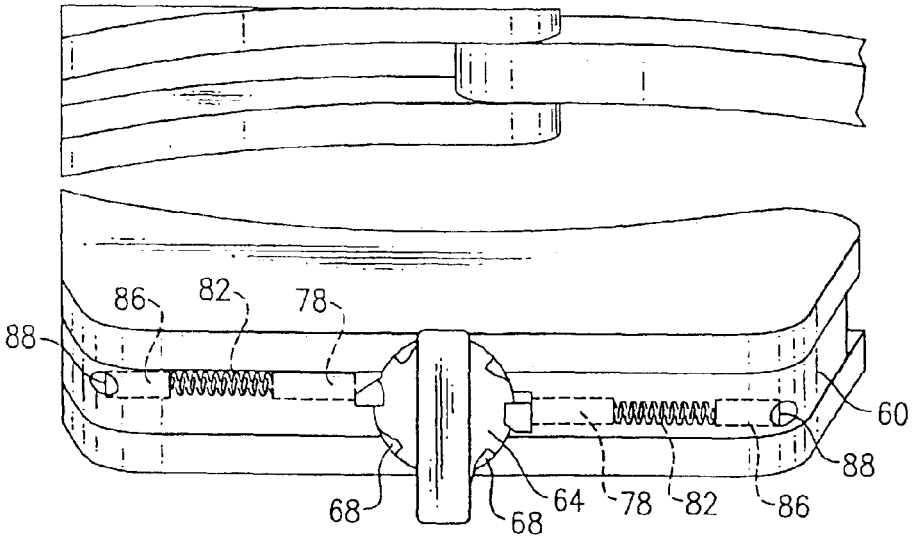
FIG. 7 is a partial side view of the restraint mechanism of FIGS. 2–6 in a locked position.
Figure 8:
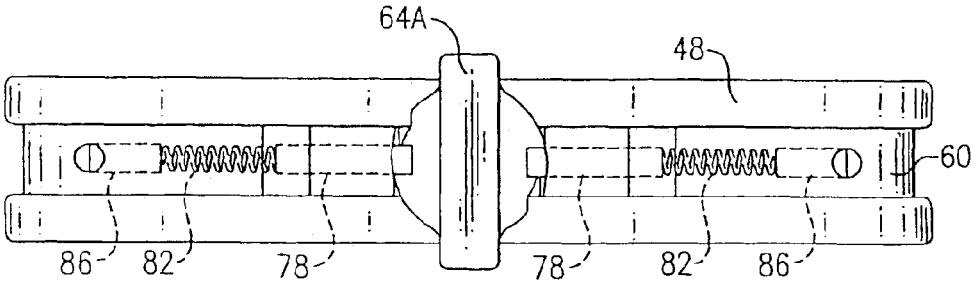
FIG. 8 is a partial side view of a selectively adjustable restraint mechanism in accordance with another preferred embodiment of the present invention.

The link 65 further includes an integral ratchet gear 64 proximally adjacent the cylindrical axle portion 72 thereof, the gear including a predetermined number of peripherally disposed engagement teeth 68. The ratchet gear 64, when assembled is aligned with a cavity 81 defined in the proximal end of the support yoke 60. A pair of ratchet pawls 78 are disposed in the interior of the distal end of the support yoke 60 extending transversely into the cavity 81 of the support yoke, relative to the linkage axis 94, FIG. 10. The ratchet pawls 78 are each axially aligned with the ratchet gear 64, each of the pawls 78 being biased against interior end surfaces 88 of the support yoke 60 through means of a spring 82 and an axial retainer pin 86. Each of the ratchet pawls 78 include a rounded engagement end 90 that is appropriately sized to engage with the teeth 68 of the ratchet gear 64 of the link 65 when the bracelet section 48 is caused to rotate in one rotational direction 96, FIG. 10, and to engage the gear on opposing sides thereof. This engagement restricts rotation of the linkage when the bracelet section is rotated in the other rotational direction 98, FIG. 10, about the linkage axis 94. This engagement between the ratchet pawls 78 and the ratchet gear 64 of link 65 is shown in greater detail for purposes of this embodiment according to FIGS. 5–7. The bracelet section 48 can therefore be locked at a predetermined number of angular or engagement positions depending on the number of engagement teeth 68. The ratchet gear 64 according to the present embodiment provides a total of eight (8) equally spaced angular positions for the bracelet section 48 positions, though this number can be easily varied. For example, an alternate ratchet gear 64A having only two engagement positions is depicted in FIG. 8.

In this embodiment, a single ratchet gear 64 is utilized wherein only one of the bracelet sections 48 is rotatable about the linkage axis 94. It will be readily apparent, however, that the linkage could, for example, include ratchet gears at either bracelet section.

Figure 9:
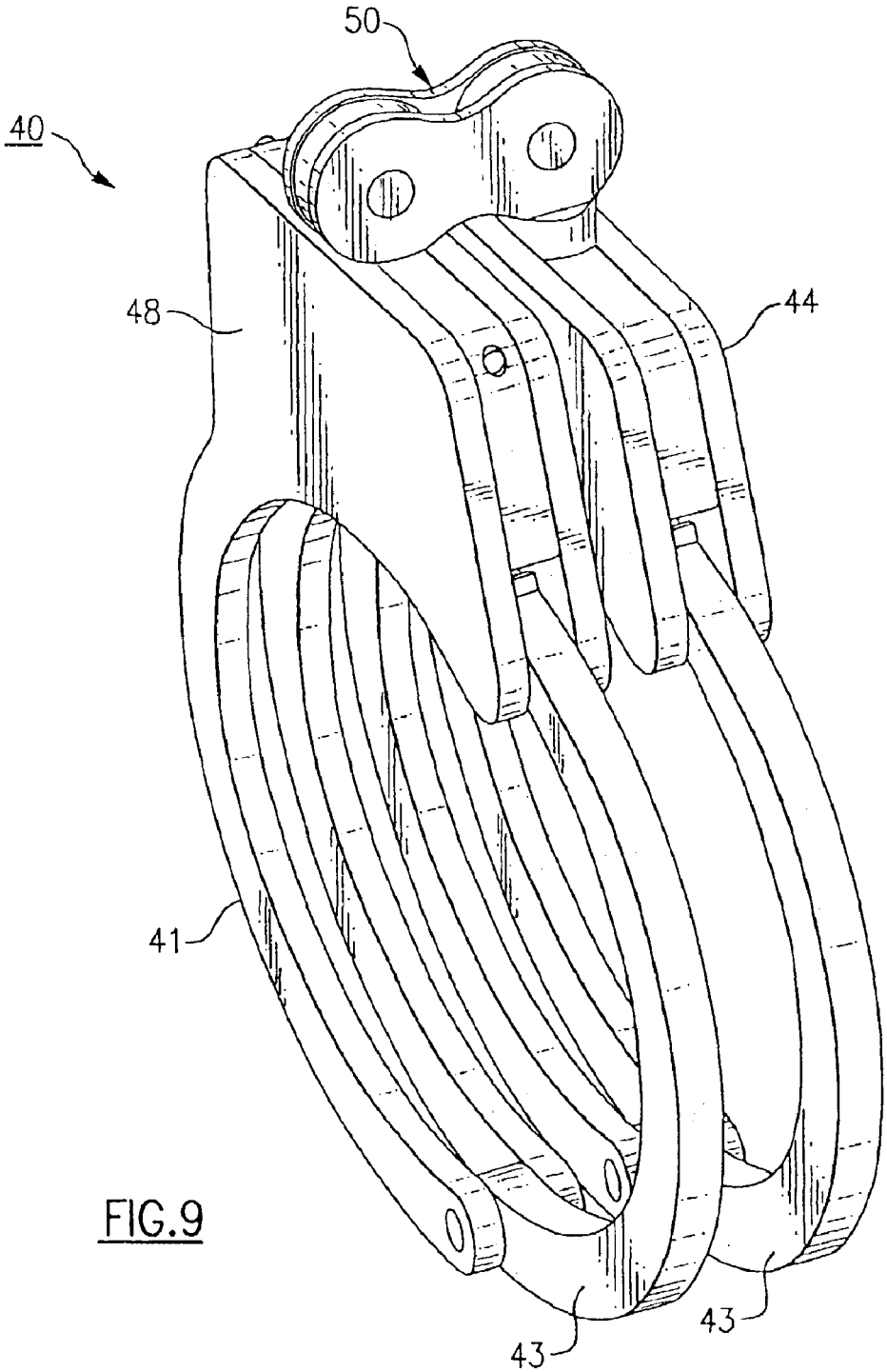
FIG. 9 is an isometric view of the handcuffs of FIGS. 2–7 as shown in a folded or storage position.

As is shown in FIG. 9 and due to the flexible pivotable support provided between the links 62, 65, each being connected to a corresponding bracelet section 44, 48, the handcuffs 40 incorporating the above restraint mechanism 50 can be folded downwardly in a conventional manner for storage and therefore can be used with known handcuff holders (not shown). Moreover, the restraint mechanism herein described does not add significant size or weight to the handcuffs 40 as compared to already existing handcuffs. Therefore, incorporation of the above restraint mechanism

50 does not significantly interfere with the typical operation or design of known handcuffs.

Figure 11:
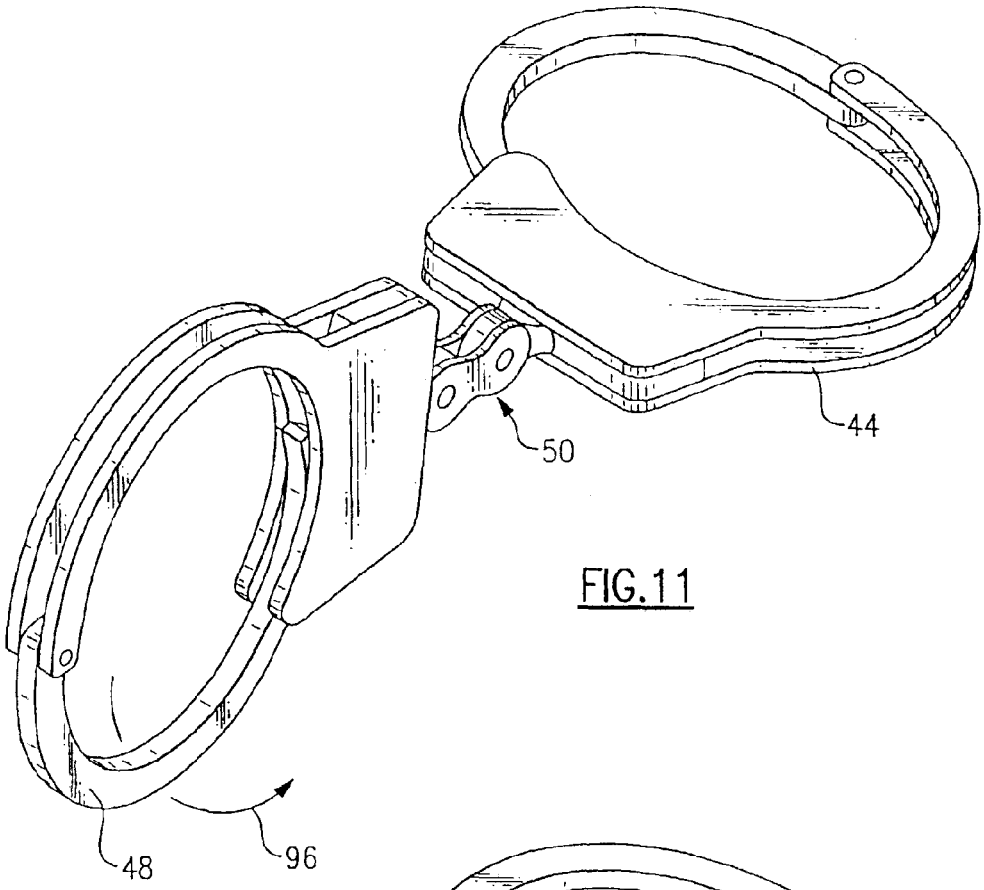
FIGS. 11 and 12 are the front perspective view of the handcuffs of FIG. 10 illustrating the positioning of the bracelet sections to certain specified or predetermined angular positions, using the restraint mechanism of the present invention.
Figure 12:
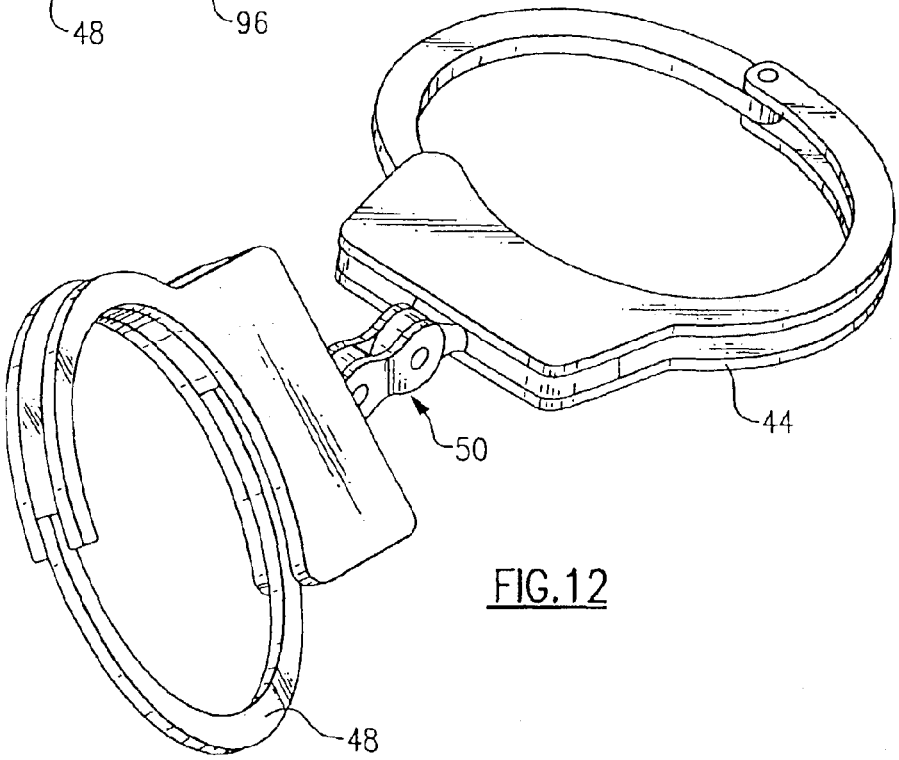

Referring to FIGS. 9–15 and having described the basic features of the handcuffs 40, the operation of the restraint mechanism 50 will be illustratively described. As shown in FIG. 10, it can be seen that the bracelet section 48 is entirely rotatable about the linkage axis 94 to any one of the number of predetermined angular positions based on the engagement of the teeth 68 of the ratchet gear 64 with the rounded engagement section 90 of each opposing spring biased ratchet pawl 78. Once rotated to any predetermined angular position in a first rotational direction 96, the bracelet section 48 cannot be rotated back to its original or nominal position due to the above ratcheting action, thereby preventing any movement in the opposite rotational direction, shown as 98. Examples of predetermined angular positions in which the handcuffs 40 can be arranged are shown in FIGS. 11 and 12.

Figure 14:
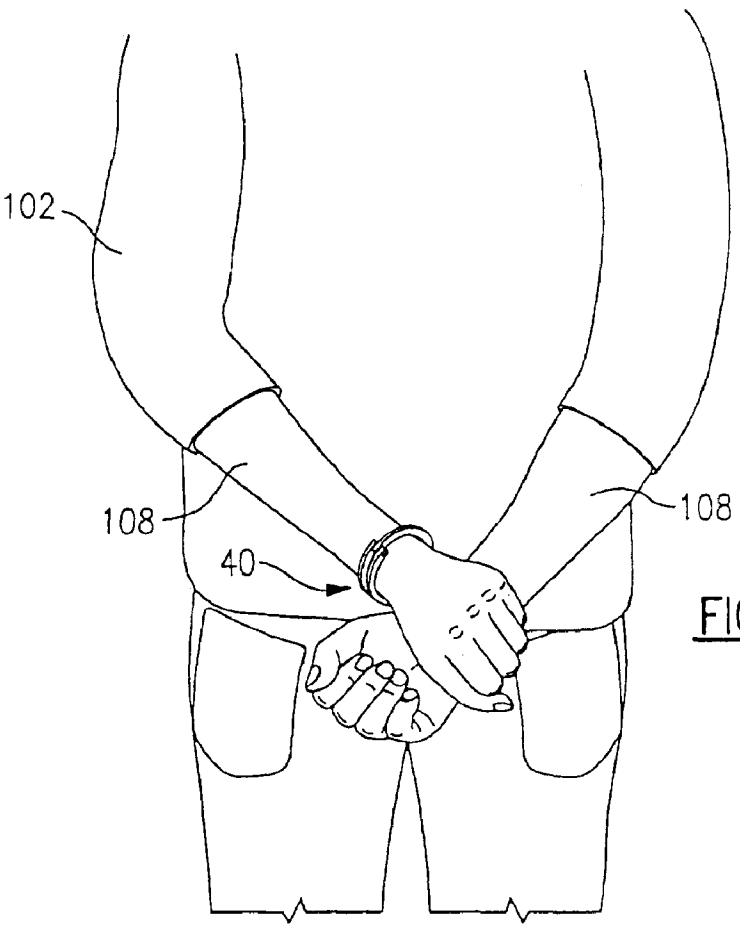
FIGS. 13, 14 and 15 are rear elevation views of a person wearing the handcuffs of FIGS. 10–12, these views illustrating respective arm positions as a bracelet section is placed in a nominal position, a 90 degree position, and an 180 degree position in accordance with the method of the restraining present invention.
Figure 13:
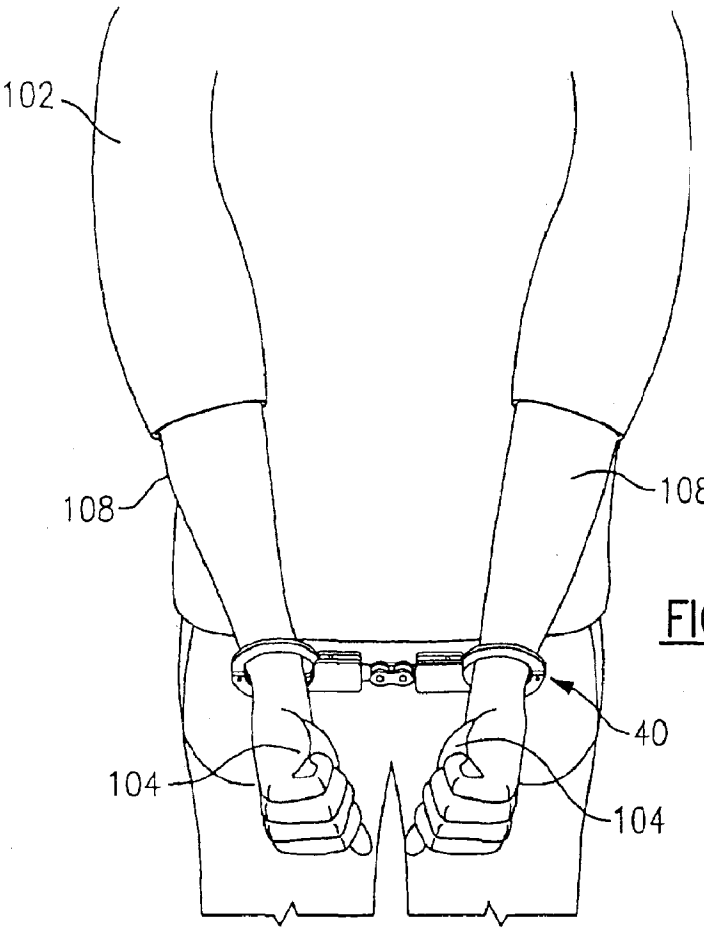
Figure 15:
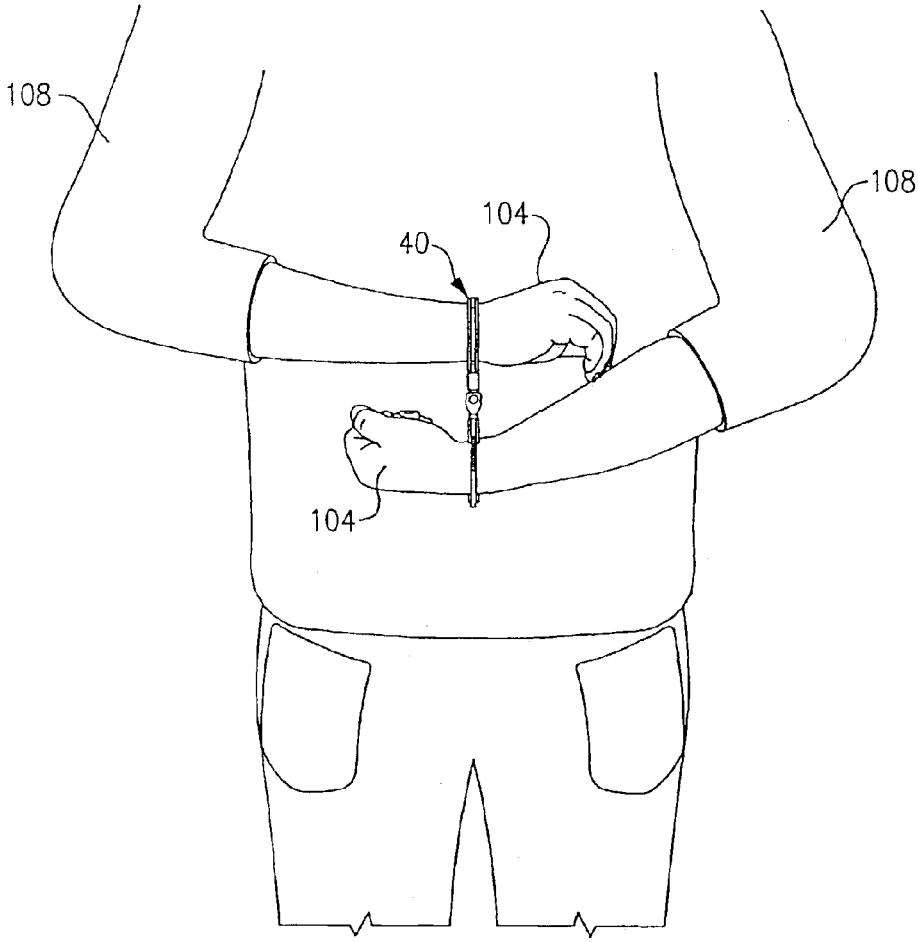

The overall effect of the above mechanism to a person who has been handcuffed is shown by way of example in FIGS. 13–15. FIG. 13 illustrates an individual or detainee 102 who has been handcuffed from behind, such that the handcuffs 40 are attached at each wrist in an ordinary or nominal position. In this position, the palms 104 of the hands of the detainee 102 face one another and the arms 108 are generally in a vertical attitude.

FIG. 14 illustrates a first locked position that is assumed when the bracelet section 48 has been rotated to a first predetermined angular position, in this instance the 90° position shown in FIG. 11. This position can be achieved by rotating either of the cuffed arms 108 in the desired rotational direction 96, FIG. 10. It should be readily apparent that other positions could have been selected. In this position, the arms 108 are pulled from the vertical attitude and are caused to fold at the elbows. Because of the ratcheting nature of the restraint mechanism 50, the individual 102 cannot rotate either his hands or the handcuffs 40 back to the original position depicted in FIG. 13.

A further rotational position is illustrated in FIG. 15 wherein the arm/bracelet section 48 has now been rotated 180 degrees (that is, an additional 90 degrees from the position of FIG. 14) relative to the original or nominal position shown in FIG. 13. In this position, the arms 108 are additionally rotated until the arms are crossed one above the other with the palms 104 still facing one another, the detainee 102 now being in a much more secure position than the nominal position of FIG. 13. As a result and from this position, which cannot be achieved with conventional handcuffs, the handcuffed individual cannot "step-through" the handcuffs 40, thereby posing less of a threat to a law enforcement officer. Moreover, the positioning of the arms 108 behind the back, as depicted in FIGS. 14 and 15, is in fact more comfortable for the detainee 102 than the position shown in FIG. 13. It should be readily apparent that alternate or intermediate positions can be assumed, depending on the degree of rotation of the bracelet section 48. It should be pointed out that a similar scenario would apply to a detainee who has been cuffed from the front, meaning that the detainee's arms would be caused to similarly fold as the bracelet section 48 is rotated in the manner previously described.

Parts List for FIGS. 1–15

10 handcuffs
14 cuff or bracelet sections
16 cheek member
18 jaw member
20 row of arcuate teeth
26 center pivot point
34 chain linkage
37 pin
40 handcuffs
41 cheek member
43 jaw member
44 bracelet section
45 center pivot point
47 row of arcuate teeth
48 bracelet section
50 restraint mechanism
56 support yoke
60 support yoke
62 link
64 ratchet gear
64A ratchet gear
65 link
66 support yoke half sections
68 teeth
72 cylindrical axle portion
73 interior facing surface
74 cover plates
75 hub
76 fasteners
77 openings
78 ratchet pawls
79 openings
80 slot
81 cavity
82 springs
86 axial retainer pins
88 interior end surfaces
90 rounded engagement end
94 linkage axis
96 rotational direction
98 rotational direction
102 detainee
104 palms
108 arms Though the present invention has been particularly shown and described with reference to the preferred mode as illustrated in the drawings, it will be understood by one skilled in the art that various changes in detail may be effected therein without departing from the spirit and scope of the invention as defined by the claims.

I claim:

1. A set of handcuffs comprising:

a pair of openable bracelet sections, each of said bracelet sections including a locking mechanism for opening and closing a said bracelet section;

linkage means for tethering said bracelet sections together; and a restraint mechanism connected to said linkage means, said mechanism permitting at least one bracelet section to be angularly rotated about a linkage axis extending through said linkage means and said bracelet sections so as to rotate said bracelet section to a predetermined angular position relative thereto wherein rotation of said at least one bracelet section in a first rotational direction about said linkage axis enables said bracelet section to assume at least one annular locking position and in which said restraint mechanism includes means for preventing said bracelet section from being rotated to a previous annular Position in a second rotational direction opposite from the first rotational direction once a succeeding angular locking Position has been assumed.

2. A set of handcuffs as recited in claim 1, wherein said restraint mechanism includes a ratchet gear that is rotatable about said linkage axis, said ratchet gear having a number of teeth disposed thereabout; and at least one ratchet pawl engageable with said teeth for preventing said ratchet gear from rotating in said second rotational direction upon engagement thereof.

3. A set of handcuffs as recited in claim 2, wherein said restraint mechanism further includes two ratchet pawls, each of said ratchet pawls being disposed on opposite sides of said ratchet gear.

4. A set of handcuffs as recited in claim 3, wherein each of said ratchet pawls are biased into contact with said ratchet gear.

5. A set of handcuffs as recited in claim 4, wherein engagement of the biased ratchet pawls with the teeth of the ratchet gear restricts further movement of the gear in said second rotational direction about said linkage axis but permits further rotational movement in the opposite first rotational direction.

6. A set of handcuffs as recited in claim 1, wherein said at least one bracelet section can be rotated and locked in at least (2) two predetermined angular positions.

7. A set of handcuffs as recited in claim 1, wherein said at least one bracelet section can be rotated and locked in at least eight (8) predetermined angular positions.

8. A set of handcuffs as recited in claim 1, wherein said linkage means includes means for permitting said bracelet sections to be folded onto one another for storage.

9. A set of handcuffs as recited in claim 1, wherein said linkage means includes at least one pair of link elements which are axially connected to one another by means of at least one interconnecting cover plate.

10. A set of handcuffs as recited in claim 9, including support yokes provided on said bracelet sections for receiving each of said link elements.

11. A set of handcuffs as recited in claim 10, wherein at least one of said link elements includes a hub enabling pivotal and axial attachment to said support yoke.

12. A set of handcuffs as recited in claim 1, including detent means for indicating when a said bracelet section has been rotated to a predetermined locking position.

13. A set of handcuffs as recited in claim 1, wherein use of said locking mechanism to open said bracelet sections is the only means for resetting the restraint mechanism.

14. A method of restraining an individual using a set of handcuffs said handcuffs having a pair of bracelet sections separated by a flexible linkage, said method including the steps of:

cuffing an individual using said handcuffs; and rotating at least one of the bracelet sections of said handcuffs to a predetermined angular position in a first rotational direction about a linkage axis extending through said flexible linkage and each of said bracelet sections, said handcuffs further including a restraint mechanism having means for preventing said bracelet section from being rotated in an opposite second rotational direction to a previous angular position once said restraint mechanism has been engaged and said bracelet section has been rotated to at least a first predetermined angular position while permitting said bracelet to be additionally rotated in said first rotational direction.

15. A method as recited in claim 14, including the step of cuffing said individual behind said individual's back.

16. A method as recited in claim 14, including the step said individual in front of said individual.

17. A method as recited in claim 14, wherein said rotation step includes the step of rotating the arms of the cuffed individual relative to one another about the linkage axis.

18. A method as recited in claim 14, wherein said rotation step includes the step of rotating the arms of the cuffed individual relative to the linkage axis.

19. A method as recited in claim 18, wherein said arm rotation step causes the arms of the cuffed individual to fold into an overlapping position to prevent step through.

20. A method as recited in claim 14, including the step of rotating the arms of the cuffed individual 90 degrees relative to said linkage axis.

21. A method as recited in claim 14, including the step of uncuffing the individual as the only means of releasing the restraint mechanism once the individual has been cuffed.

22. A method as recited in claim 14, the step of providing a detent to indicate to a user when a predetermined locking position has been reached.

* * * * *